US006000812A

United States Patent [19]

Freeman et al.

[11] Patent Number: 6,000,812

[45] Date of Patent: Dec. 14, 1999

[54] WRITABLE DISK SIGN

[75] Inventors: Timothy A. Freeman; Veso S. Tijanic, both of Mississauga, Canada

[73] Assignee: Mark IV Industries Limited, Mississauga, Canada

[21] Appl. No.: 08/971,192

[22] Filed: Nov. 17, 1997

[51] Int. Cl.[6] ..... F21V 21/00

[52] U.S. Cl. ..... 362/249; 362/31; 362/40; 362/252; 362/277; 362/280; 362/281; 362/319; 362/351; 362/800; 362/812; 362/235; 40/449; 40/452

[58] Field of Search ..... 362/249, 252, 362/40, 277, 280, 281, 319, 351, 31, 800, 812, 235

[56] References Cited

U.S. PATENT DOCUMENTS 5,497,573 3/1996 Stadjuhar et al. ..... 40/564
5,640,792 6/1997 Smith et al. ..... 40/546
5,771,616 6/1998 Tijanic ..... 40/452
5,793,343 6/1991 Hart et al. ..... 345/84
5,909,971 6/1999 Tijanic ..... 40/449

*Primary Examiner*—Sandra O'Shea
*Assistant Examiner*—John A. Ward
*Attorney, Agent, or Firm*—Robert L. Westell

[57] ABSTRACT

An array of disks faces a viewing direction is composed of disk's rotatable about an axis approximately perpendicular to the viewing direction between alternating orientations where bright and dark sides are respectively displayed in the viewing direction. There is provided a row of LED's located forwardly of the array and out of the normal viewing path located to illuminate the disks of said array. Masking means prevents direct illumination from said LED's being visible in the viewing direction.

11 Claims, 4 Drawing Sheets

WRITABLE DISK SIGN

Figure 1:
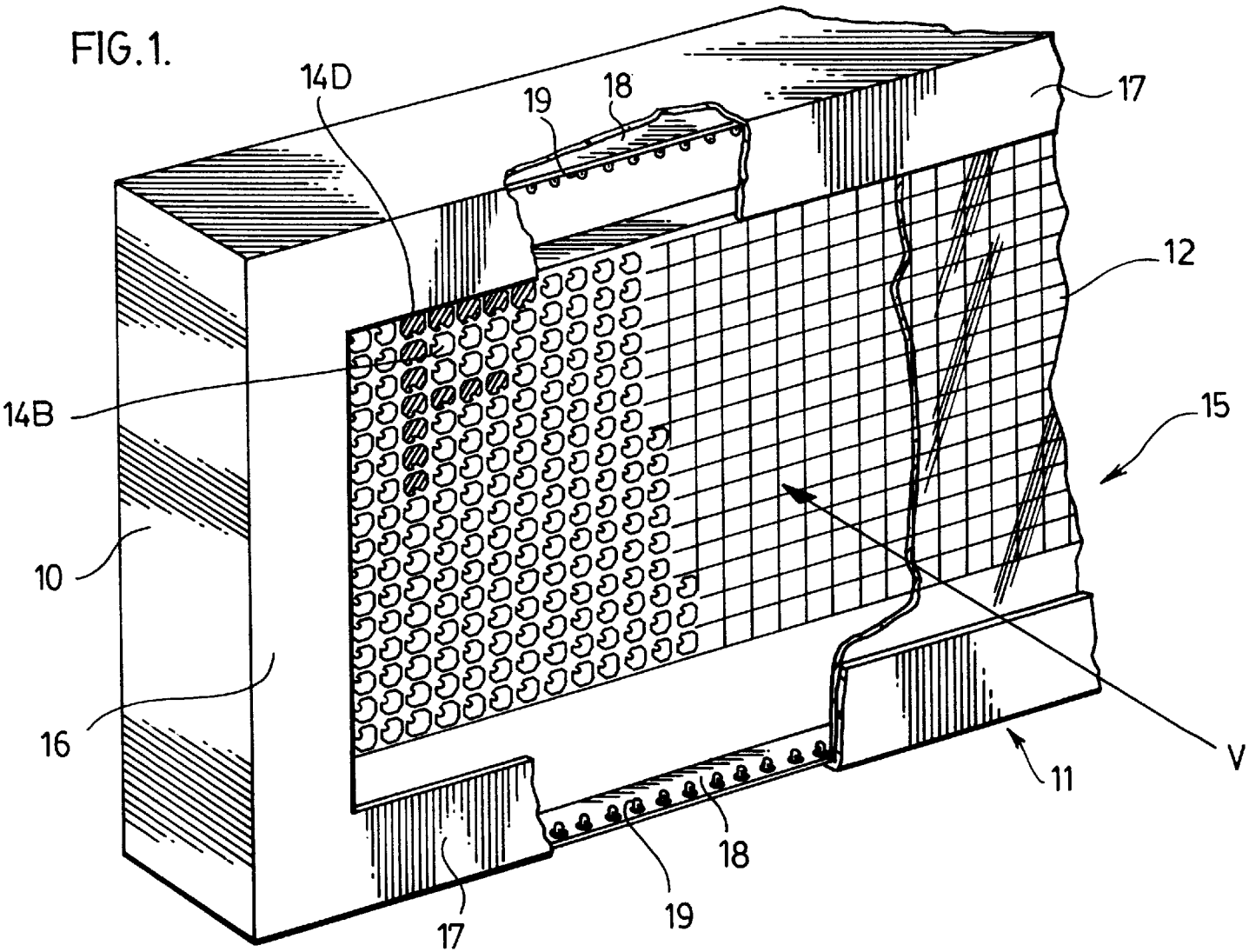

This invention relates to novel means for illuminating an array of flip disks using LEDs. The novel lighting design, may be used for any purpose but it is particularly suitable for an array surrounded by its own housing, such as vehicle destination signs, since it allows the physically forward side of the array to approach closer to the front transparent wall or windshield than many prior designs. The design also lends itself to retro-fitting of an array formerly lit by fluorescents located at the edges.

The following abbreviations are used herein:

LED—light emitting diode

PCB—printed circuit board

PWB—printed wiring board

PWB is a synonym for PCB and PCB is used herein,

'Forward' is the direction from the array toward the intended viewer and 'backward' is the opposite direction.

A 'side' refers to any outer edge of the active elements in a display.

The array of display elements can be generally planar, but if curved (as in some vehicle destination signs) can still be thought of as defining a median plane. This is usually perpendicular to the intended viewing direction.

In comparison with fluorescents, LEDs are solid slate devices with a lifetime much longer than fluorescents. LEDs require no ballasting and the power consumption will be 10 to 20 times less than that of fluorescent circuits.

Moreover recent developments in LED technology have introduced higher intensity LEDs and a broad range of color selection and radiation angle. Color selection should be made to approach, as closely as possible the monochromatic color of the bright surface of the disk elements. In accord with a broad aspect of the invention a row of LEDs extends along one side of an array and forward of the median plane, but clear of the intended viewing path. Preferably there is provided a row of LEDs on opposed sides of the array. The LEDs are directed and selected to illuminate the array of elements. The radiation cones of the LEDs are also selected for best illumination. A masking surface corresponding to each LED row prevents direct viewing of the LEDs by a viewer looking in the viewing direction.

The array is composed of disk elements rotatable about an axis generally transverse to the ordinary viewing direction. With such disk elements the ON side displays a bright surface in the viewing direction and the OFF side a dark surface.

Thus, the light directed from the LEDs is reflected from the disk bright sides, some of it in the viewing direction, to improve the clarity and appearance of the sign for viewing. This clarity is enhanced if the color of the light is close to that of the disk bright sides.

It is found that particularly good results are obtained when the illumination is by two rows of LEDs located on opposite sides of an array. The rows of LEDs located on opposite sides of an array. The rows are located forwardly of the plane of the array and outside the cross section occupied by the array in the viewing direction which is opposite the rows. Thus, a mask plate may be located to mask each row to the viewer.

There are prior arrays in a transparent front, housing, lit by fluorescents. The invention may be retrofit into the housing by removing the fluorescents and installing opposed rows of LEDs in the casing, clear of the viewing lines for the plane of the array. Masking plates are then provided to mask the LEDs from the viewer.

PCB's are particularly suitable for mounting the LEDs.

LEDs in opposed rows located on mutually opposed sides of the array lend themselves to location and direction to produce relatively even illumination. In one arrangement the LEDs in an opposed row include a set which illuminates a region of elements at the near edge of the array and a set which illuminates a central region. The combination of the two sets in each of the opposed rows may thus be arranged to illuminate each side strip and the central strip between the side strips in a relatively even manner.

LEDs in this arrangement may be chosen for their beam angle. Thus, in relation to the arrangement described in the previous paragraph, those LEDs in the set used for (primarily) illuminating elements adjacent the near edge have been found effective with the lens selected to have a cone of between 15° and 25° included angle, while the LEDs used for (primarily) illuminating the middle region preferably have cones between 35° and 45° included angle.

Figure 2:
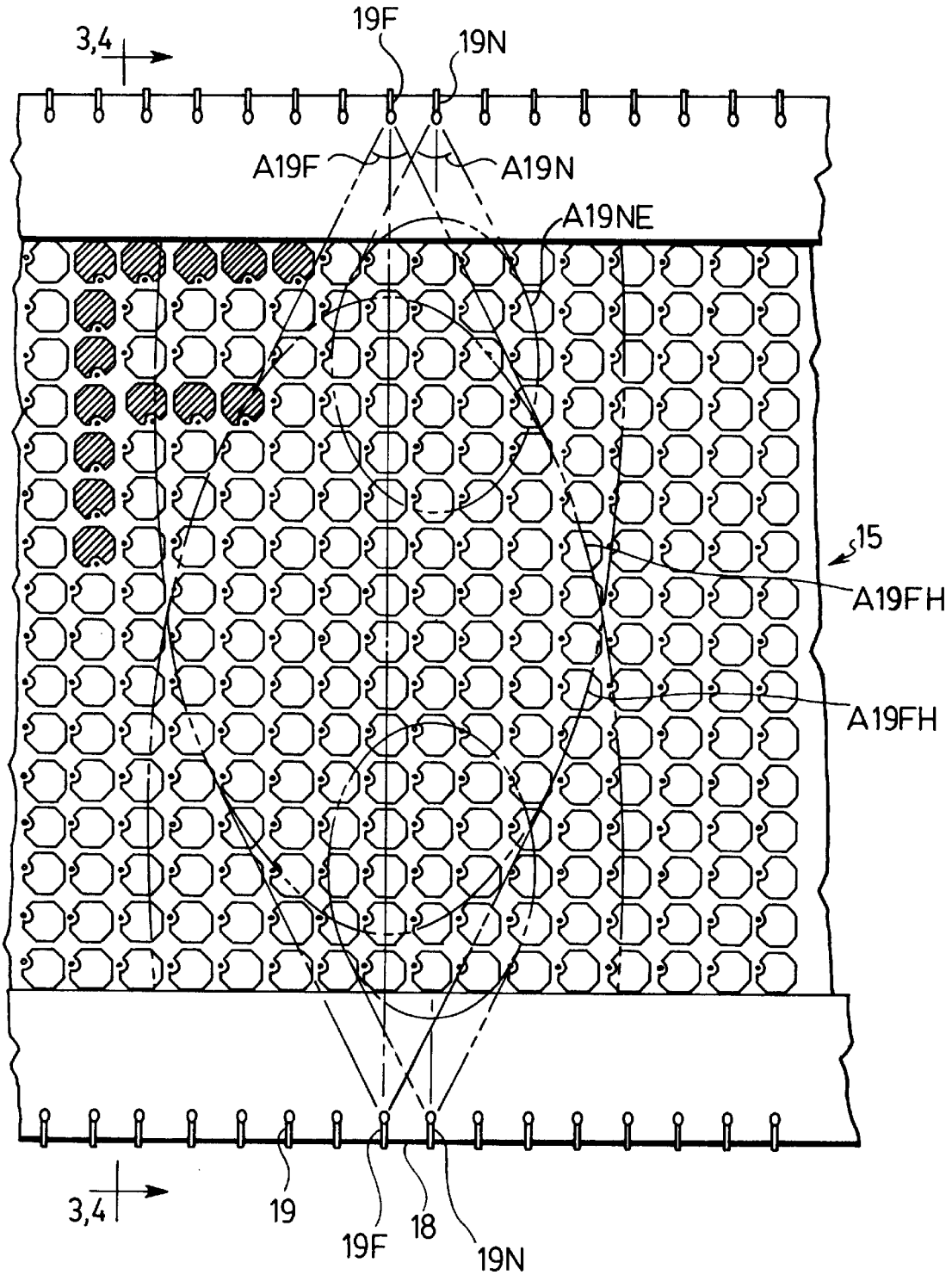
Figure 3:
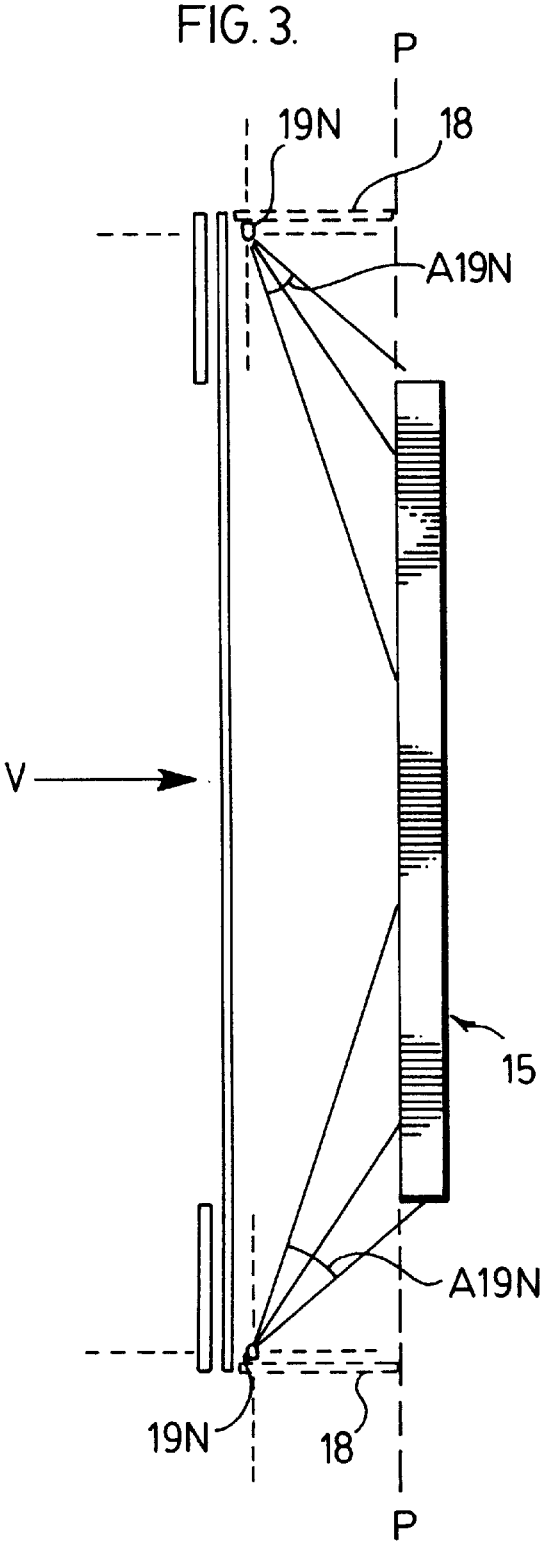
Figure 4:
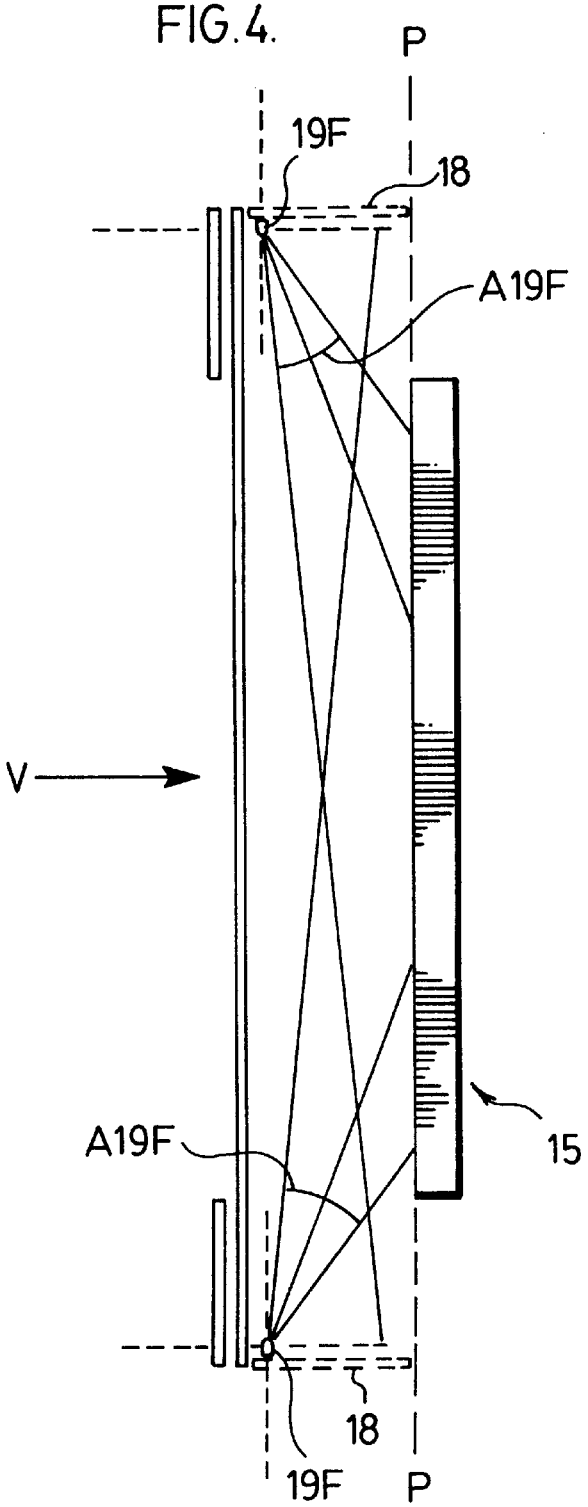
Figure 5:
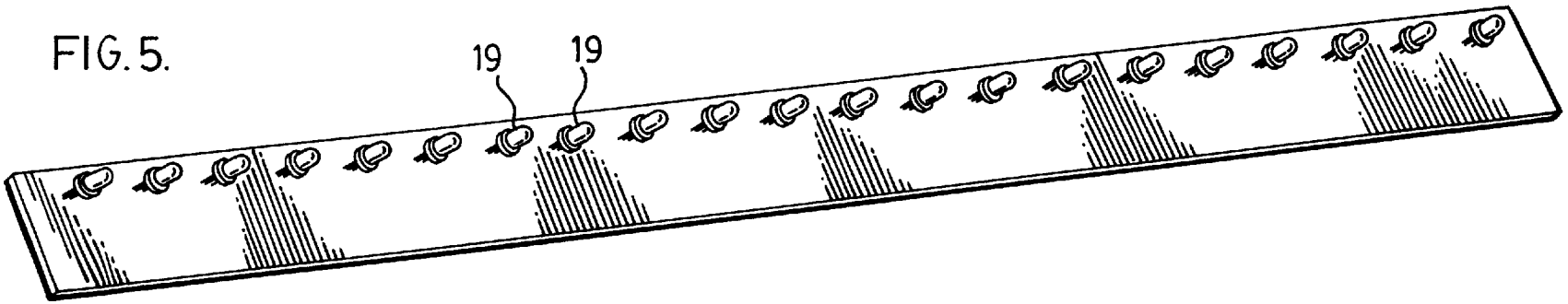
Figure 6:
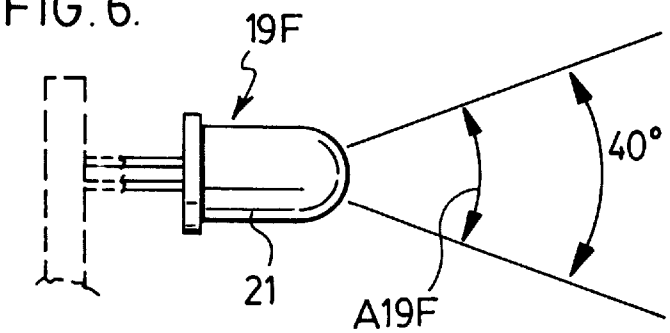
Figure 7:
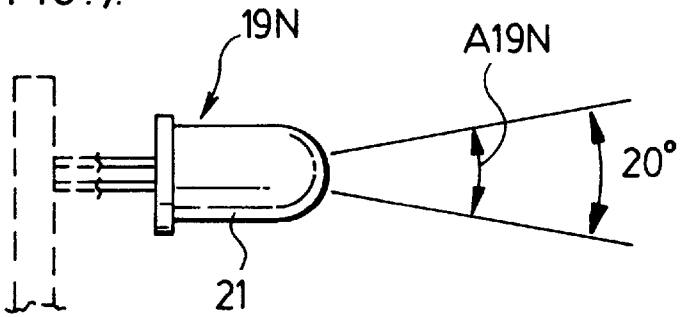

FIG. 1 is a somewhat schematic perspective of a casing containing an array,

FIG. 2 is a schematic front view of the casing and array showing exemplary representations of the cones of LEDs arranged and focused to illuminate display elements in the array regions near respective rows of LEDs, and in the array region between the LEDs, FIG. 3 is a section along the lines 3, 4–3, 4 of FIG. 2 showing the boundaries, in section, of cones of LEDs used in sets to illuminate regions of the array near respective illuminating LEDs, FIG. 4 is a section along the lines 3, 4–3, 4 of FIG. 2 showing the boundaries, in section, of cones of LEDs used to illuminate regions of the array, approximately midway the rows of illuminating LEDs, FIG. 5 shows a row of LEDs and lenses on PCB for illuminating the array, FIG. 6 demonstrates an LED with lens for producing a cone for illuminating the array central region, FIG. 7 demonstrates an LED with lens for producing a cone for illuminating edge adjacent regions, FIG. 1 shows a housing 11 including side walls 10, back wall (not shown) and a glass front 12. The casing contains an array 15 with horizontal rows and vertical columns of flip disks 14 which are selectively electromagnetically operable to show a bright face 14B or a dark face 14D in the viewing direction V.

The flip disks are usually electromagnetically operated in accord with well known techniques. Flip disks which operate in this way are shown for example in U.S. patents:

U.S. Pat. No. RE. 35,357 Oct. 22, 1996 Browne

U.S. Pat. No. 5,022,171 Jun. 11, 1991 Norfolk

U.S. Pat. No. 4,577,427 Mar. 25, 1996 Browne

However, some of the U.S. patents will indicate use of LEDs or fibres to augment the visual effect of the bright side of the disk. This augmentation is not required with this invention because front lighting of the disks is provided.

In accord with the preferred form of the invention the disks 14 are shown displaying their bright sides 14B with the exception of 14 disks displaying their dark side 14D in the upper left corner of the array which collectively form an F against the bright side disks 14B.

The operation of the array will not be described since there are a number of ways of operating it well known to those skilled in the art. Normal operation is electromagnetic although other drives may be used.

The housing 11 may in some cases previously have formerly housed a pair of fluorescent tubes located to light an array of display elements located where array 15 is now. Thus if this is a 'retrofit' the former housing for the array may be used.

The housing thus comprises the side walls 10, and bottom walls, not shown, with a glass cover 12 and a frame, of walls 16 of which upper and lower walls 17 are masks as hereinafter described.

Between the plane of the array 15 and the glass 12 are located opposed rows of LEDs 19 for illuminating the array as hereinafter described.

Preferably a row of LEDs is provided on each of the opposed sides of the array. The opposed sides will usually be chosen to face each other across the array's narrow dimension. The LED rows are located just forward of the plane of the array and clear of the array section as seen by viewers looking in the viewing direction.

Preferably the LEDs are mounted on printed wiring boards or on printed circuit boards, here PCBs 18. The PCBs are very suitable for carrying the wiring (not shown) for the LED chips (not shown) and for mounting such LED chips.

The LED lens 21 may be selected to define the desired cone for LED radiation.

The 'viewing direction' 'V' is the central to the viewing cone.

'Forward' and 'rearward' herein are the direction toward and away from a viewer looking in direction V.

Glass cover 12 usually protects the array by closing off the front of the housing.

LEDs 19N and 19F form part of the row RL and RF.

Many arrangements of the LEDs and lenses may be used to give substantially even illumination to the bright sides of the disks of the array.

A method which has been found useful to produce good results is that a set of LEDs in each row are focussed and directed to cover an area near the row and second set to cover a central area.

Thus as shown in FIG. 7 LEDs and lenses 19N may illuminate the array with a 20° included angle cone A19N whose axial sections are shown in FIG. 3 and whose projection on the plane of the array P—P is shown in FIG. 2 as ellipses A19E.

As shown in FIG. 6 LEDs 19F may illuminate the array with a 40 included angle. The sections on the plane of the array P—P are shown in FIG. 4 and whose projection is shown as hyperbole A19H.

Thus with the lens of the LEDs selected and focussed as indicated, the sets of LEDs 19F and 19N on each side of the array are selected and they are located to collectively produce approximately equal illumination. LED size and energization may also easily be selected.

The invention is not limited to a particular mode of illumination or combination of illuminating LEDs but the discussion demonstrates the wide availability of approaches which may be taken with the inventive arrangement.

With whatever type of lighting is selected the mask is located to prevent anyone within expected viewing location from being able to see the lights directly.

I claim:

1. An array of disks defining a median plane and a viewing direction from intended locations forwardly of said plane, each said disk being rotatable about an axis approximately transverse to the viewing direction, between alternate orientations where bright and dark sides are respectively displayed in the viewing direction, at least one row of LEDs located forwardly of the plane of the array and outside the array as viewed in the viewing direction, wherein said LEDs are directed to shine rearwardly on, forwardly facing bright sides of disks in said array;

masking means for preventing direct illumination from said LEDs travelling to said viewing locations.

2. In an array as claimed in claim 1 wherein the color of radiation from said LEDs approaches the color of said disk bright sides.

3. In array as claimed in claim 1 having said rows of LEDs on opposite sides of said array.

4. In array as claimed in claim 2 having said rows of LEDs on opposite sides of said array.

5. In an array as claimed in claim 3 wherein each of said rows comprises a first set of LEDs arranged to direct radiation toward an outer region of said array near said set and a second set of LEDs arranged to direct radiation toward a central area between opposite side outer areas.

6. An array, defining a viewing direction, said array being composed of disks reversible to selectively present opposite bright or dark faces to the viewing direction, a forwardly open housing therefor, having said array therein facing the open side of said housing, side walls extending forwardly of said array, LEDs located on each side of said array directed to shine rearwardly on forward facing bright sides of disks, in said array.

7. An array as claimed in claim 6 wherein the color of radiation from said LEDs is close to the color of said disk bright sides.

8. An array as claimed in claim 6 wherein each of said rows comprises a first set of LEDs arranged to direct radiation toward an outer area of said array near said set and a second set of LEDs arranged to direct radiation toward a central area between opposite side outer areas.

9. An array as claimed in claim 7 wherein each of said rows comprises a first set of LEDs arranged to direct radiation toward an outer area of said array near said set and a second set of LEDs arranged to direct radiation toward a central area between opposite side outer areas.

10. An array as claimed in claim 2 wherein said LEDs are mounted on PCBs.

11. An array as claimed in claim 6 wherein said LEDs are mounted on PCBs.

* * * * *